US005690228A

United States Patent [19]

DeMatteis

[11] Patent Number: 5,690,228

[45] Date of Patent: Nov. 25, 1997

[54] T-SHIRT BAG STYLE AND SYSTEM

[76] Inventor: Robert DeMatteis, 1668 Mill Stream Dr., Chino Hills, Calif. 91709

[21] Appl. No.: 655,470

[22] Filed: May 30, 1996

[51] Int. Cl.[6] ..... B65D 33/10; B65D 33/14

[52] U.S. Cl. ..... 206/554; 206/806

[58] Field of Search ..... 206/554, 806; 383/8, 9

[56] References Cited

U.S. PATENT DOCUMENTS

| | | | |
|---|---|---|---|
| 3,380,579 | 4/1968 | Pinto | 206/554 |
| 4,106,733 | 8/1978 | Walitalo | 206/554 X |
| 4,759,639 | 7/1988 | De Matteis | 206/554 X |
| 4,811,417 | 3/1989 | Prince et al. | 206/554 |
| 5,333,730 | 8/1994 | Boyd | 206/554 |

*Primary Examiner*—Jacob K. Ackun

*Attorney, Agent, or Firm*—Beehler & Pavitt

[57] ABSTRACT

A plastic bag pack and rod mounting means in which the bag pack is comprised of a pair of gusseted panels secured together at their bottom and side edges and leaving at least an unsecured portion of the upper edges to define a bag mouth. The gusseted panels are orificed adjacent the outer gusset edges and at the level of the bag mouth. Orificed retaining means are provided along the upper edges of the panel. The bag pack is mounted on a pair of parallel horizontal rods spaced apart from each other by the distance between the bag panel orifices, with the rods extending from a supporting backing member by a distance measured from the face of the bag pack equal to at least half of the total of the dimension of a bag gusset, when fully extended, and the dimension of the face of the bag. The orificed retaining means along the edges of the bag panels may or may not be detachable.

10 Claims, 3 Drawing Sheets

Fig. 1a
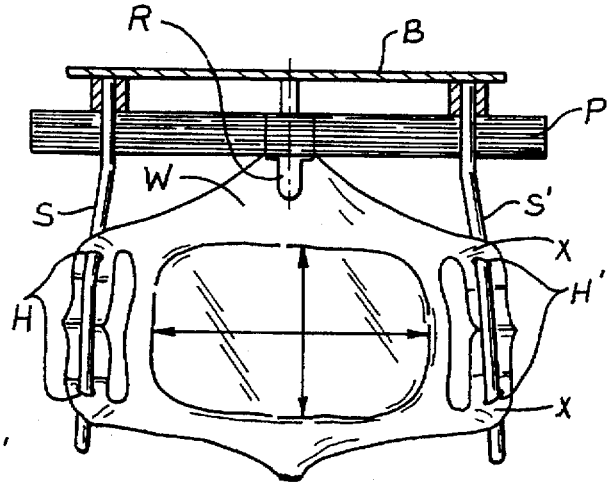
Fig. 1
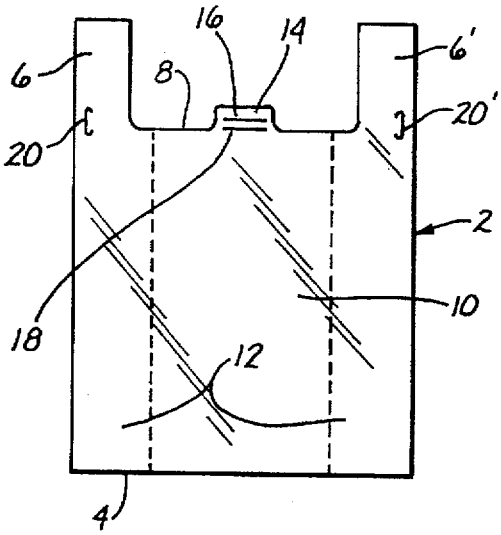
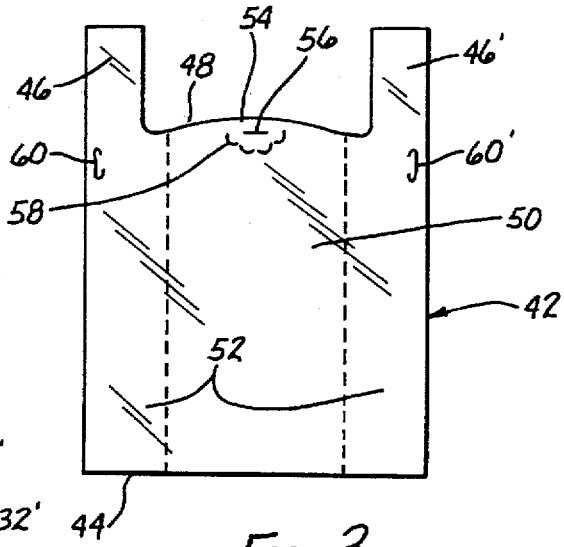
Fig. 3
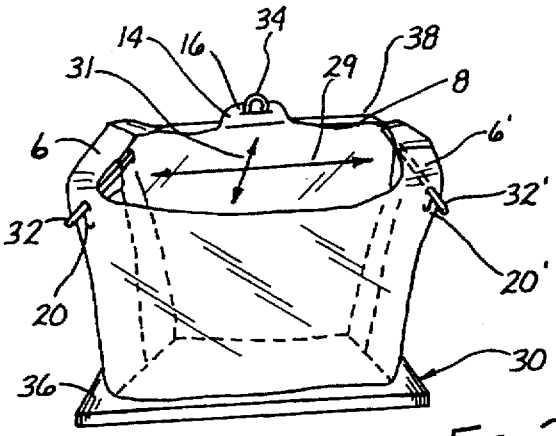
Fig. 2

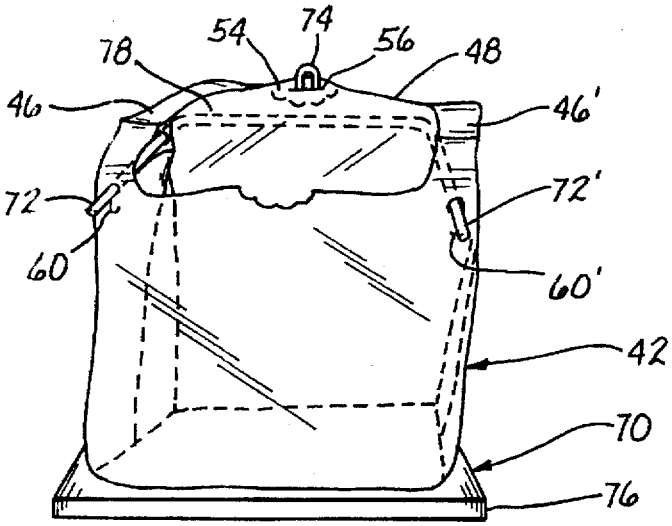
Fig. 4
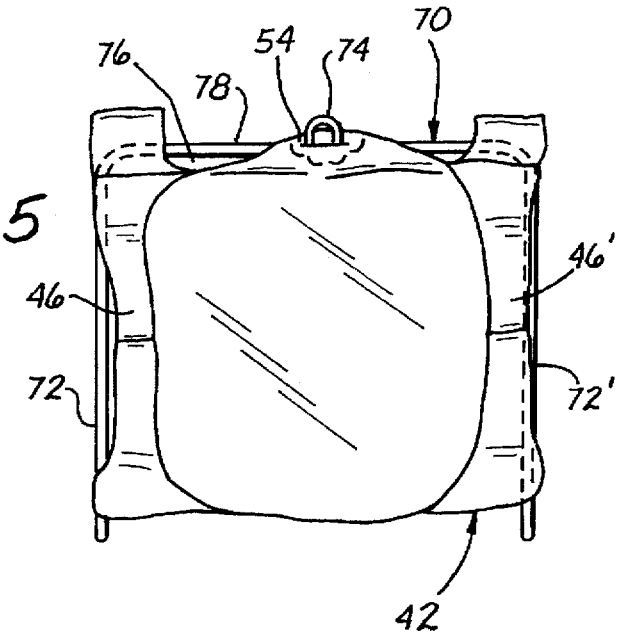
Fig. 5
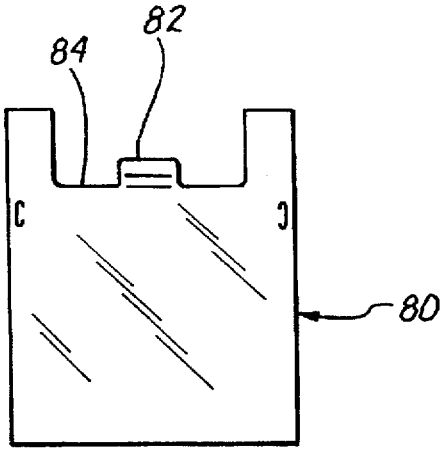
Fig. 6
Fig. 6a
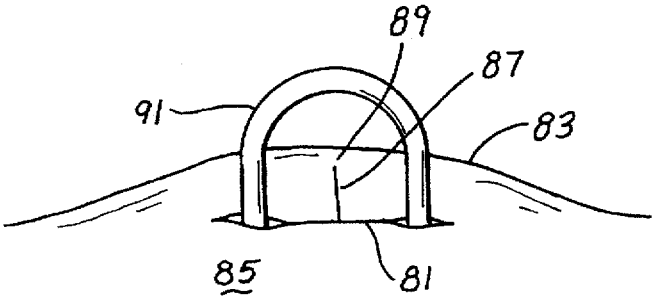

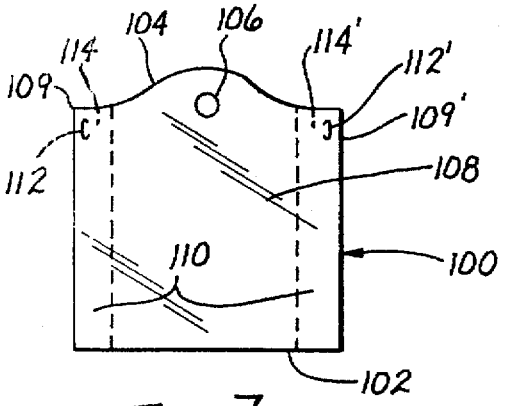
Fig. 7
Fig. 8
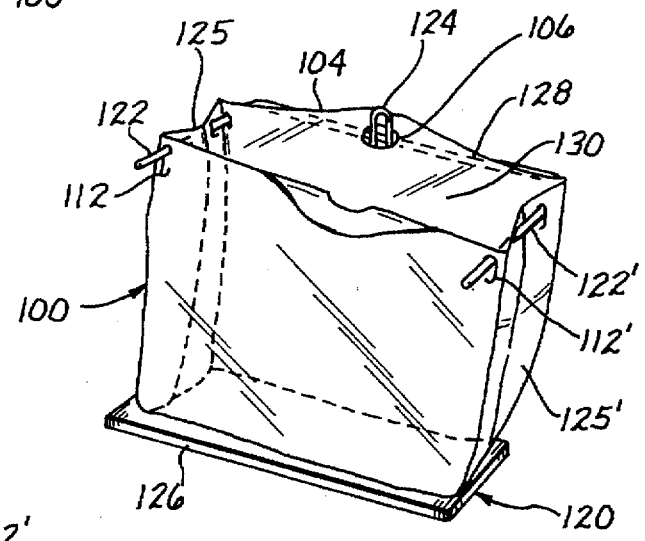
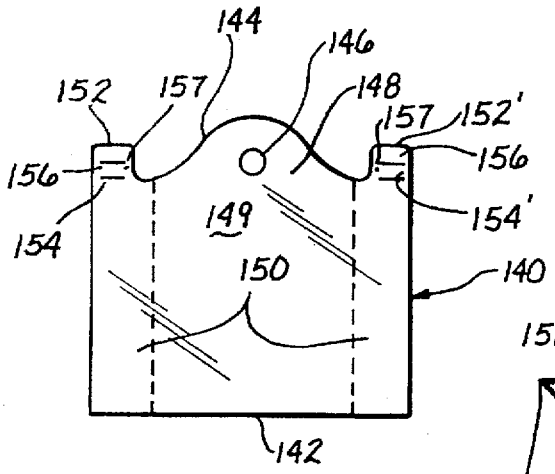
Fig. 9
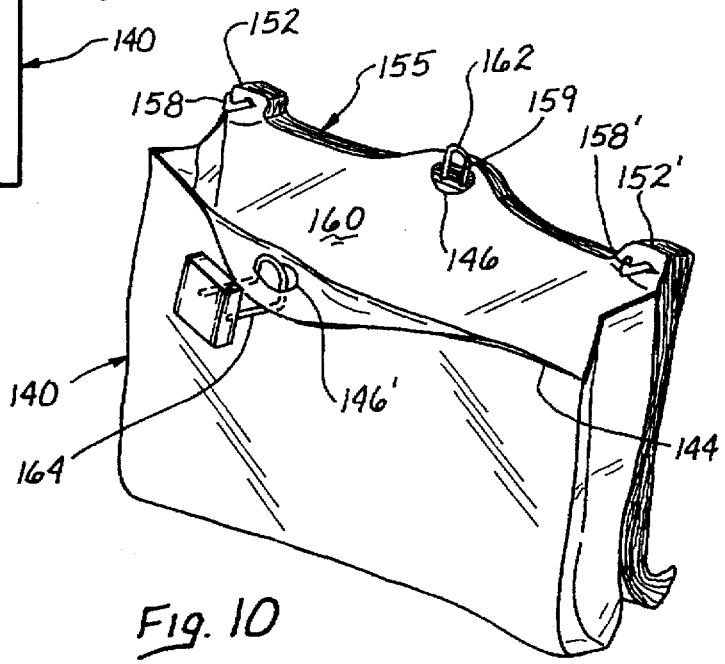
Fig. 10

T-SHIRT BAG STYLE AND SYSTEM

FIELD OF THE INVENTION

This invention relates to plastic bags and sacks such as those commonly used in supermarket, drug, discount store, foods and related trades, to carry merchandise from the store to home. More specifically, this invention relates to plastic merchandise bags and sack styles and their companion systems that can be used to substantially improve loading capacity and loading efficiency.

DESCRIPTION OF PRIOR ART

Plastic bags and sacks have become the most popular style of bag to carry merchandise from store to home, and related loading systems are preferred in high volume outlets in North America and in much of Europe, Australia and Asia. In these high volume outlets, the systems typically incorporate a rack style holder which supports the thin gauged bags while a user loads it.

U.S. Pat. No. 3,380,579 and U.S. Pat. No. 3,552,697 show mounting bags on support arms but without retention of the bag pack on the rack holder. Once a bag is loaded on this style of system, it would require the user to place one hand on the bag pack and holder while extracting the forward-most, loaded bag. With bags of such a prior art system it is also difficult to separate the bag walls and to open them, due to their means of adjoinment. The last bags in such a bag pack would be exceeding difficult to open and could potentially cause tearing at the apertures.

The most popular sack and system in use in the world today in high volume outlets is described in U.S. Pat. No. Re. 33,264. Plastic sacks of this variety have a centrally located detachable tab that extends upwardly, and holes intermediately located in each handle. These bags are generally in unitary packs of 50 or 100 bags. The unitary pack is mounted onto a rack style holder by threading the two sets of handle holes onto two rod supports and placing the centrally located detachable tab, which has an aperture, onto a centrally located retainer. The retainer holds the bag pack in place while the forward-most bag is being utilized. To prepare for utilization the clerk separates the front wall of the forward-most bag and pulls it forward, while the bag is being supported by the rod supports threaded through the handle holes, and the rear bag wall is being retained at the centrally located tab mounted onto the retainer. The user then loads the bag in this supported position. This system has proven to be an effective means of loading bags in high volume outlets worldwide, it is far more efficient than attempting to load a bag by hand, without a rack style holder.

As described in my pending patent application Ser. No. 08/626,293, a problem which is inherent with this prior art system is that when the bags are mounted on the rack style holder, they hang down below the upper support members of the rack holder. This is confirmed by the fact that the upwardly extending tab forces the bag mouth to be below the top of the rack style holder. It is further compounded by the fact that the plastic sack handles are generally 6" long and upon disposing the intermediate handle holes onto the holder's rod supports, it causes the bag and the bag mouth to hang down even further below the support rods.

A second problem associated with prior art systems is that in order to open up the bag mouth sufficiently wide so a user can load the sack, the rod supports must be spread outwards, beyond the normal distance spanning the handle holes. The handle holes mounted on the rod supports cause the handles to be stretched outwards about 11–12", with the handles pointing away from the center. The handle holes on a bag in a lay-flat position are usually spaced about 7–7½" apart and 3" above the bag mouth and about 2–3" below the top of the handles.

The result, upon opening the forward-most bag, is a bag and bag mouth that not only hangs down below the rod supports, well below the top of the rack style holder, but also has a relatively narrow, confining, oblong or rectangular shaped open-mouth configuration. This narrow, confining effect is illustrated in U.S. Pat. No. 5,125,624. As illustrated, the free hanging bag actually resists squaring itself out to its maximum potential capacity due to being forced to take on this unnatural, confining configuration. The PRIOR ART in FIG. A-1 of the accompanying drawing is a top view of the sack in the system of the '624 patent variety showing the confining effect of a much smaller bag mouth within the outer limits of the support members of the rack. This type of narrow configuration generally causes the user to under-utilize the actual capacity of the plastic sack which has become a serious problem in major retail outlets.

The PRIOR ART FIG. A-1 shows that the support members of the rack have a back support B, rack retainer R, in which the bag pack is retained, side rods supports S and S', on which handle apertures H and H' are threaded. The handles typically lay on the outside of the rod supports as illustrated, which pushes the sack's body down and inward. The confined bag mouth is illustrated by the arrows which touch the outer extremities of the opened bag mouth. This confining effect is typically due to three factors: One, when the bag is opened, the bag mouth opening is restricted by the short span between the stretched apart handle holes, typically only 4"–6" and illustrated as X. The second factor is that with the short span X, it causes the bag's rear wall W to also pull forward and away from the bag pack P, further confining the mouth opening. The third factor is that the rod supports S and S' are typically about 7–8 inches long, which is less than the required dimension to allow a bag to fully expand its potential bag mouth opening.

Being able to fill up plastic bags and sacks by utilizing the entire capacity is important in high volume outlets. If the capacity is not properly utilized, i.e. under-utilized, more bags will be used increasing both bag and labor costs. A system that utilizes as much of the available capacity in a plastic bag or sack can represent an important cost-cutting measure.

SUMMARY OF THE INVENTION

The plastic bags and sacks and their racks of the present invention increase the ability of the store clerk to utilize a bag's or sack's entire capacity. When the plastic sack of the present invention is mounted on its rack style holder, and is opened up, the bag mouth expands open wide enough to utilize most of the area defined by the rack's support rods and the bag cube for loading the bag. Furthermore, this system allows for easy removal of the bag or sack from the rack once the bag is fully loaded.

This is accomplished by using a variety of unique combinations of plastic bag and sack styles and special rack holders which allow the bag mouth of each bag to be opened to provide the widest possible volumetric capacity. In fact, the bag mouth can actually open up to a configuration which provides more area than that of the original bag dimensions. For instance, a plastic grocery sack which typically measures 12" across by 7" wide would have an open mouth area of 84" square (12" times 7"), whereas this same sized bag in the form of the present invention can take on a squared out configuration of 9.5" across by 9.5" wide (9.5" times 9.5") or an open mouth area of 90.25" square. In such a case, the rod supports must be long enough to extend out to the 9.5" configuration. The formula to determine the length of rod supports, which will be called, "LORS", in the present invention would be:

LORS=(the width of an expanded gusset)+(the width of the face)/2

By using this formula, the LORS of any bag style can be quickly established to determine how far the rod supports must extend from their supporting rack backing in order to accommodate the fullest extent of the opening of the bag mouth. In the above bag example, LORS=12+7 which sum is divided by 2. This means the rod supports must extend for a minimum of 9.5" long from the backing. A more ideal length dimension would be about 10.5 inches.

Instead of having intermediately located apertures in T-shirt sack handles which are stretched outward and create the confining effect as illustrated in the PRIOR ART FIG. A-1, the sacks in the present invention have apertures in more efficacious locations, such as the base of the handles or in the bag body and closer to the side edges. When the bag is supported on its rack holder, the latter allows the open sack's mouth configuration to exceed the original sack's dimensions (as described above). This can be utilized for a relatively wide array of bag styles when mounted upon the proper rack holders. For the ease of explanation a few variations of the two most common styles, T-shirt sacks and merchandise bags, will be discussed in detail.

In both instances the configuration of the present invention in handled T-shirt sack styles or merchandise bag styles, the sacks and bags will be retained by a retaining means which has slits which are mounted on a retainer on the rack style holder. The retaining means may be a detachable or severable portion of the bag, or a handle hole. And in using the present invention with handled T-shirt sacks, the two laterally spaced apertures are threaded onto the rod supports. When the apertures are placed on the rod supports and the centrally located retaining means is secured on the central retainer, the result is a plastic sack which, when opened by the user, squares itself out more naturally to define an area which can be greater than the original bag dimensions define. Two keys to attaining this result are 1) by having the lateral apertures spaced towards the outer limits of the sack; and by having rod supports each of a length which is at least equal to, or exceeds the normal width dimensions created by the sack's gussets.

The resultant squaring out effect of the bag mouth thus increases the area of the open bag mouth substantially and can result in the ability to load up to 20% to 30% more merchandise in the same bag. When the sack or bag is fully loaded, it is then a simple operation to locate and grasp the handles which will lay atop the rod supports, and remove the loaded sack from the rack style holder. Thus, the plastic sacks and bags of the present invention when employed with a rack herein described, lend themselves to being loaded more fully, and more easily, and are simple to use as well.

BRIEF DESCRIPTION OF THE DRAWINGS

FIG. A-1 is a view looking down from above a bag pack mounted upon a rack in the manner taught by prior art.

FIG. 1 is a plan view of a T-shirt sack which has a centrally located detachable tab and holes at the outer edge of the base of the handles.

FIG. 2 is a perspective view of the sack in FIG. 1 showing its position on a rack holder of the type upon which the sack is normally mounted.

FIG. 3 is a plan view of a preferred version of a T-shirt sack of the present invention with its centrally located detachable means and holes at the outer edges of its bag walls.

FIG. 4 is a perspective view of the sack in FIG. 3 mounted onto a rack style holder.

FIG. 5 is a top view of the sack and rack style holder in FIGS. 3 and 4.

FIG. 6 is a plan view of a variation of the T-shirt sack style in FIG. 3.

FIG. 6*a* is a partial enlarged plan view of a modification of the detachable means of the T-shirt sack style shown in FIGS. 3 and 5.

FIG. 7 is a plan view of a plastic merchandise bag of the present invention with outwardly located apertures and a centrally located handle.

FIG. 8 is a perspective view of the bag in FIG. 7 mounted upon a rack style holder of the present invention.

FIG. 9 is a plan view of a commonly known DUAL-TAB™ bag of the U.S. Pat. No. 4,759,639 variety which has no apertures, but tabs at the outer edges.

FIG. 10 is a perspective view of the bag in FIG. 9 mounted on a rack style holder for this type of bag.

DETAILED DESCRIPTION OF THE PREFERRED EMBODIMENTS

In FIG. 1 plastic sack 2 has a bottom 4, two handles 6 and 6', a bag mouth 8, a body 10, and side gusset panels 12. The centrally located retaining means 14 at the sack's mouth 8 is detachable. This means 14 has a slit 16 within its perimeter, which perimeter is defined by line 18 below. Handles 6 and 6' have handle holes 20 and 20' located near the base of the handles and toward the outer edges of said handles. Handle holes 20 and 20' extend through the entire sack 2 including the gusset panels 12.

In FIG. 2, rack style holder 30 has two rod supports 32 and 32', a centrally located retainer 34 and a base 36. Rod supports 32 and 32' are connected along the back side of rack style holder 30 by brace 38, which generally, together with said rod supports represents the top of rack style holder 30. Sack 2 is mounted onto rack style holder 30 by threading body holes 20 and 20' onto rod supports 32 and 32' respectively. Detachable tab 14 is secured on retainer 34 by slipping slit 16 over said retainer. With sack 2 fully opened, sack mouth 8 is now proximate to the top of brace 38 and rod supports 32 and 32'; and handles 6 and 6' will lay generally atop and inside said rod supports. As indicated by the arrows 29 and 31, the bag mouth opening is noticeably enhanced when compared to that of the Prior Art FIG. A-1.

In FIG. 3 plastic sack 42 has a bottom 44, two handles 46 and 46', a bag mouth 48, a body 50, and side gusset panels 52. The retaining means which is centrally located below the sack's mouth 48 in body 50 is detachable portion 54, which has a slit 56 within its perimeter, which perimeter is defined by perforation line 58 below and sack mouth 48 above. At the outer edges of body 50 and below handles 46 and 46' are holes 60 and 60' respectively.

In FIG. 4, rack style holder 70 has two rod supports 72 and 72', a central retainer 74 and a base 76. Rod supports 72 and 72' are connected along the back side of rack style holder 70 by brace 78, which generally, together with said rod supports represents the top of rack style holder 70. Sack 42 is mounted onto rack style holder 70 by threading body holes 60 and 60' onto rod supports 72 and 72' respectively. Detachable portion 54 is secured on retainer 74 by slipping slit 56 over said retainer. With sack 42 fully opened, sack mouth 48 is now proximate to the top of brace 78 and rod supports 72 and 72', and handles 46 and 46' lay atop, or slightly inward of said rod supports.

FIG. 5 illustrates the top view of what is shown in perspective in FIG. 4. There may be seen sack 42 on rack 70 with handles 46 and 46' on top and slightly inward of rod supports 72 and 72' with detachable means 54 secured onto retainer 74. FIG. 5 clearly illustrates the effect of extending rod supports 72 and 72' out a distance determined by the LORS formula set forth above on page 4 of this specification. As compared to the Prior Art FIG. A-1, FIG. 5 clearly illustrates the significant enhancement of the area of the open sack mouth of the present invention.

FIG. 6 shows a sack 80 which is identical to sack 42 in FIG. 3 except that the retaining means, detachable portion 82, extends upwardly from sack mouth 84. When mounting sack 80 on its complementary rack holder, it is easy to understand the result would be substantially the same as with the sack and rack system described in FIGS. 3, 4 and 5.

In FIG. 6A, in lieu of a detachable tab or portion (such as 54 in FIGS. 3, 4 and 5) being used as a retaining means, a horizontal slit 81 is provided and located below bag mouth 83. Slit 81 is mounted onto retainer 91 which means is substantially the same as those in FIGS. 4 and 5. However, adjacent and above slit 81 is a vertical severance line 87 which leaves intact a narrow piece 89 of unsevered bag wall material between the upper end of line 87 and bag mouth edge 83. Upon forcefully removing bag wall 85 from retainer 91, the narrow unsevered piece 89 of bag wall 85 breaks, freeing the bag wall 85 from the retainer 91.

In FIG. 7 a merchandise bag 100 (as contrasted with the T-shirt bags previously discussed with reference to FIGS. 1–6A), has a bottom 102, a bag mouth 104, side gussets 110 and a centrally located die cut handle 106 which is cut through both front and back walls of bag body 108. At the upper outer corners 109 and 109' of bag 100 are mounting holes 112 and 112' and these outer corner regions are cold welded at spots 114 and 114' to maintain the pack of bags 100 in alignment.

In FIG. 8, rack style holder 120 has two rod supports 122 and 122', a central retaining means 124 and a base 126. Rod supports 122 and 122' are connected along the back side of rack style holder 120 by brace 128, which generally, together with said rod supports 122, 122' represents the top of rack style holder 120. Merchandise bag 100 is mounted onto rack style holder 120 by threading holes 112 and 112' onto rod supports 122 and 122' respectively. On the back wall 130, die cut handle 106 slips over retainer 124. With bag 100 fully opened, bag mouth 104 is now near the level of the top of brace 128 and rod supports 122 and 122'. With this style of merchandise bag, which has a face much wider than its gussets, it would not be necessary to use the LORS formula to determine the optimum rod length, but to simply have the rod supports 122, 122' extend to at least the width of the unfolded side gussets 125, 125'.

In FIG. 9 DUAL-TAB™ bag 140 has a bottom 142, a mouth 144, side gussets 150 and a centrally located die cut handle orifice 146 cut through bothwalls (only the front wall 149 being shown) of bag body 148. At the upper outer extremities of body 148 are tabs 152 and 152'. These tabs are attached to bag body 148 by severance lines 154 and 154' respectively. Tabs 152 and 152' have respective slits 156 and 156'. An entire pack of bags 140 may be adjoined by a heat seals or cold welds 157 and 157' in tabs 152 and 152'.

In FIG. 10 bag pack 155 is mounted onto its rack by threading tabs 152 and 152' onto retainers 158 and 158' respectively, and sliding all sequential handle holes 159 onto the central retainer 162. Forward-most bag 140 is opened by mounting front wall handle hole 146' onto an opposing retainer 164. With rear handle hole 146 retained on retainer 162, bag mouth 144 is opened up wide.

While the embodiments of the invention described above with reference to the drawings disclose a specific means of creating a system to enhance the bag mouth openings, it should not be considered as being confined to only portable rack style holders. For instance, any type of rack style holder or system which is used in bagging at a check-out counter may be devised to utilize the principles of the present invention to accomplish the objective of augmenting the opening of the bag mouth.

What is claimed:

1. A plastic T-shirt bag having a lower openable portion for receiving and retaining articles to be carried in the bag, said portion being accessible through a centrally disposed mouth, said mouth being partially defined laterally by a pair of handles spaced from each other and extending upwardly from bases on each side of said bag mouth, said bag being formed of a front wall and a back wall secured together around their bottom and side edges and across the upper handle edges, said side edges being folded inwardly to form gussets having their folded edges disposed between the bag walls; mounting orifices extending through the bag walls and gussets, each mounting orifice being disposed adjacent, but spaced inwardly of a side edge of the bag at the approximate level of the bases of the handles; the upper central portion of the bag walls defining the bag mouth between the bases of the pair of handles, and including at least one orificed retainer means.

2. The bag as described in claim 1 wherein the orificed retaining means is centrally located adjacent the bag mouth.

3. The bag as described in claim 1 wherein the orificed retaining means extends above the bag mouth.

4. The bag as described in claim 1 wherein the orificed retaining means is located below the bag mouth.

5. The combination of a pack of plastic T-shirt merchandise bags and a dispensing rack therefor, each plastic T-shirt bag having a lower openable portion for receiving and retaining articles to be carried in the bag, said portion being accessible through a centrally disposed mouth, said mouth being partially defined laterally by a pair of handles spaced from each other and extending upwardly from bases on each side of said bag mouth, said bag being formed of a front wall and a back wall secured together around their bottom and side edges and across the upper handle edges, said side edges being folded inwardly of to form gussets having their folded edges disposed between the bag walls; mounting orifices extending through the bag walls and gussets, each mounting orifice being disposed adjacent, but spaced inwardly of a side edge of the bag at the approximate level of the bases of the handles; the upper central portion of the bag walls defining the bag mouth between the bases of the pair of handles, and including at least one orificed retainer means; and the dispensing rack comprising a pair of parallel co-extensive horizontal rods spaced from each other by the distance between the mounting orifices extending through the bag walls and gussets, said rods being supported by backing means disposed at a height not less than the distance between the lower edges of the bags of the bag pack and the bag mounting orifices extending through the bag walls and gussets; each of said rods extending from said backing means for a distance at least as great as the thickness of bag pack plus the distance between the bag walls when a bag of the pack is disposed on the rods and is open to its widest extent; and said backing means further having a retainer disposed intermediate the rods, and in alignment with the orificed retainer means in the bags of the pack, and passed through said orificed retainer means.

6. The combination as described in claim 5 wherein the length of each rod measured outwardly from the face of the bag pack from which it extends, when the bag pack is mounted on the rods, is not less than one-half of the combined width of a bag gusset when expanded and the width of the bag face.

7. The combination as described in claim 5 wherein the retainer is disposed at a level slightly higher than the level of the rods; and each orificed detachable retaining means is disposed to extend centrally upwardly from the bag wall edges defining the bag mouth.

8. The combination as described in claim 5 wherein the length of each rod measured from the face of the bag pack from which it extends, when the bag pack is mounted on the rods, is not less than one-half of the combined width of a bag gusset, when expanded, and the width of the bag face.

9. The combination as described in claim 5 wherein the orificed retaining means is detachable.

10. The combination as described in claim 5 whereas the retaining means is a centrally located die cut hole.

* * * * *